US009605925B1

(12) United States Patent
McRoberts

(10) Patent No.: US 9,605,925 B1
(45) Date of Patent: Mar. 28, 2017

(54) BUMP FIRE GRIP

(71) Applicant: Josh M. McRoberts, Spokane, WA (US)

(72) Inventor: Josh M. McRoberts, Spokane, WA (US)

( * ) Notice: Subject to any disclaimer, the term of this patent is extended or adjusted under 35 U.S.C. 154(b) by 127 days.

(21) Appl. No.: 14/645,866

(22) Filed: Mar. 12, 2015

(51) Int. Cl.
*F41C 23/00* (2006.01)
*F41C 23/10* (2006.01)
*F41C 3/00* (2006.01)

(52) U.S. Cl.
CPC ..... *F41C 23/10* (2013.01); *F41C 3/00* (2013.01)

(58) Field of Classification Search
CPC ..... F41C 23/10; F41C 3/00
USPC ..... 42/71.02
See application file for complete search history.

(56) References Cited

U.S. PATENT DOCUMENTS 2,744,448 A * 5/1956 Allen ..... F41A 3/54 42/69.03
3,405,470 A * 10/1968 Wesemann ..... F41C 23/06 42/1.06
5,722,195 A * 3/1998 Bentley ..... F41C 23/10 42/1.06
6,101,918 A * 8/2000 Akins ..... F41A 19/03 89/129.01
7,926,216 B2 * 4/2011 Bentley ..... F41C 23/06 42/1.06
8,127,658 B1 * 3/2012 Cottle ..... F41A 19/11 42/69.01
8,176,835 B1 * 5/2012 Cottle ..... F41A 19/11 42/69.01
8,356,542 B2 * 1/2013 Cottle ..... F41A 19/11 42/69.01
8,371,208 B2 * 2/2013 Cottle ..... F41A 19/11 42/69.01
8,448,562 B2 * 5/2013 Cottle ..... F41A 19/11 42/69.01
8,474,169 B2 * 7/2013 Cottle ..... F41C 23/04 42/73
8,561,338 B2 * 10/2013 Chvala ..... F41C 23/08 16/430
8,607,687 B2 * 12/2013 Cottle ..... F41A 19/11 42/75.03
8,806,791 B2 * 8/2014 Cottle ..... F41A 19/11 42/71.01
2012/0240442 A1 * 9/2012 Cottle ..... F41A 19/11 42/71.01
2016/0187099 A1 * 6/2016 Cottle ..... F41C 23/14 42/73

* cited by examiner

*Primary Examiner* — Samir Abdosh
(74) *Attorney, Agent, or Firm* — Lee & Hayes, PLLC

(57) ABSTRACT

A pistol grip that assists in bump firing a pistol is disclosed. The bump fire grip may comprise a partially hollow exterior shaft that can contain an interior shaft. The interior shaft can be sized to slide from the front to the back of the exterior shaft, and vice versa. The interior shaft can slide on one or more pins, wherein the pins are lockedly engaged in the exterior shaft, pass through the interior shaft, but are not attached to the interior shaft. The bump fire grip can also employ a male/female grove design such that male groves on the exterior shaft can receive female groves on the interior shaft. The interior shaft can slide on the male/female groves. The bump fire grip can also include a locking mechanism, which, when engaged, can prevent the interior shaft from sliding within the exterior shaft, prohibiting bump firing.

11 Claims, 8 Drawing Sheets

BUMP FIRE GRIP

BACKGROUND

To fire a semi-automatic firearm, such as a pistol, the operator generally holds the grip of the firearm and squeezes the trigger, causing a round of ammunition that is situated in the barrel of the weapon to be struck be the hammer or firing pin. The strike from the hammer or firing pin causes the gun powder in the round to ignite, propelling the bullet from the cartridge of the round through and out of the barrel. In a semi-automatic firearm, additional bullets can be held in the magazine of the weapon. When a bullet is fired from the weapon, the recoil from firing ejects the spent cartridge, loads a new cartridge from the magazine, and resets the hammer and trigger on the weapon. Once the subsequent ammunition round is chambered into the barrel, the trigger can be squeezed again, causing another shot to be fired. Thus, for semi-automatic firearms, the time expended between shots is dependent on the operator's ability to physically squeeze the trigger. This is in contrast to an automatic weapon wherein the trigger is engaged once and the weapon automatically fires multiple ammunition rounds without the operator needing to squeeze the trigger a second or subsequent time.

Some government agencies regulate the purchase and use of both semi-automatic and automatic firearms, with automatic firearms generally being more regulated than semi-automatic firearms. Due to the heightened regulations for automatic firearms, semi-automatic firearm operators that desire to discharge rounds in rapid succession have turned to varied methods of doing so. One such method is call bump firing. Generally, bump firing uses forward force from the operator's non-trigger hand and the recoil of the firearm to push the trigger against the operator's trigger finger while keep the trigger finger stationary. The operator pushes the weapon forward while keeping pressure on the trigger, causing the weapon to fire rapidly. One crude method of bump firing is for the operator to place his or her finger from one hand on the trigger while gripping the weapon with the other hand and pushing the weapon against the trigger finger. Another technique employs the use of the operator's belt loop, wherein the operator's trigger finger is held in place by the belt loop while the operator's other hand is used to push the weapon forward. By maintaining pressure against the trigger finger while the weapon is firing, instead of squeezing the trigger after each shot, each round is fired in rapid succession. These bump firing techniques result in decreased accuracy, and because of the placement of the operator's trigger hand near the barrel of the weapon, increases the danger of accidental injury from hot gas and used chambers as they are discharged from the barrel. Also, these bump firing techniques require that the weapon be held with only one hand, increasing the chances that the operator will lose control of the weapon during operation.

To combat against these dangers and decreased accuracy, bump fire devices have been created for use on semi-automatic rifles, with the bump fire mechanism positioned in the butt of the rifle and frequently using force applied by the operator's shoulder to achieve the bump firing technique. However, such bump fire mechanisms cannot be applied to pistols, which do not have a butt, do not employ the operator's shoulder, and operate differently than pistols.

SUMMARY

The present disclosure provides a more accurate and safer bump fire device for use in a pistol grip. The bump fire device can include a pistol grip having an exterior shaft with at least a partially hollow interior portion. A shaft can be placed within the partially hollow interior and sized such that it makes up only a portion of the partially hollow interior portion. At least one pin can extend from the front side of the grip located in the direction of the gun's muzzle, through the interior shaft, and into the back wall of the grip located in the direction of the gun's hammer. The pin can be fixed in the exterior shaft but not fixed to the interior shaft, allowing the interior shaft to slide from front to back on the pin within the exterior shaft. The interior shaft can be releaseably attached to the gun barrel, and when attached, the weapon can be fired. The operator can hold the grip with one hand while pushing the weapon forward with the other, causing the trigger to be engaged and the gun to be fired. The recoil from the weapon pushes the weapon backward, but due to the presently disclosed bump fire grip, the grip can maintain its position. The operator's continued forward force on the weapon with the non-trigger hand can push the weapon forward again, firing another shot.

The bump fire device can also be configured such that the internal shaft can include female groves and the interior portion of the exterior shaft can include male groves. The female groves of the internal shaft and the male groves of the exterior shaft can be engaged to hold the interior shaft within the exterior shaft and allow the interior shaft to slide from front to back, and vice versa, within the grip. The interior shaft can be releaseably attached to the gun barrel, and when attached, the weapon can be fired. The operator can hold the grip with one hand while pushing the weapon forward with the other, causing the trigger to be engaged and the gun to be fired. The recoil from the weapon pushes the weapon backward, but due to the presently disclosed bump fire grip, the grip can maintain its position. The operator's continued forward force on the weapon with the non-trigger hand can push the weapon forward again, sliding the weapon forward from the grip and firing another shot.

The bump fire grip can also include a locking mechanism on the distal end of the exterior shaft. When the interior shaft of the bump fire grip is slid forward toward the muzzle, the locking mechanism can be pushed upward and into the interior portion of the exterior shaft, abutting the interior shaft or pin and prohibiting the interior shaft from sliding from front to back on the pins or male and female groves. When engaged, the locking mechanism can prohibit bump firing and can allow the operator to fire the weapon as would be done with a typical pistol grip. The locking mechanism can be disengaged by pulling it down toward the distal end of the exterior shaft and out of the interior portion of the exterior shaft. The locking mechanism can be engaged and disengaged at the operator's discretion such that the operator need not change grips or otherwise dismantle the weapon to switch from bump firing to typical firing.

The bump fire grip disclosed herein will become more readily appreciated and understood from a consideration of the following detailed description of the exemplary embodiments of the present disclosure when taken together with the accompanying drawings.

FIGURES

Various embodiments of the present invention are described herein by way of example in connection with the following figures, wherein.

DESCRIPTION

The present invention will now be described to provide an overall understanding of the principles of the structure, function, manufacture, and use of the devices disclosed herein. One or more examples of the present invention are illustrated in the accompanying drawings. Those of ordinary skill in the art will understand that the devices specifically described herein and illustrated in the accompanying drawings are non-limiting embodiments and that the scope of these embodiments is defined solely by the claims. The features illustrated or described in connection with one embodiment may be combined with the features of other embodiments. Such modifications and variations are intended to be included within the scope of the appended claims.

In general, the present invention is directed to a bump fire grip as can be seen in FIGS. 1-9.

Figure 1:
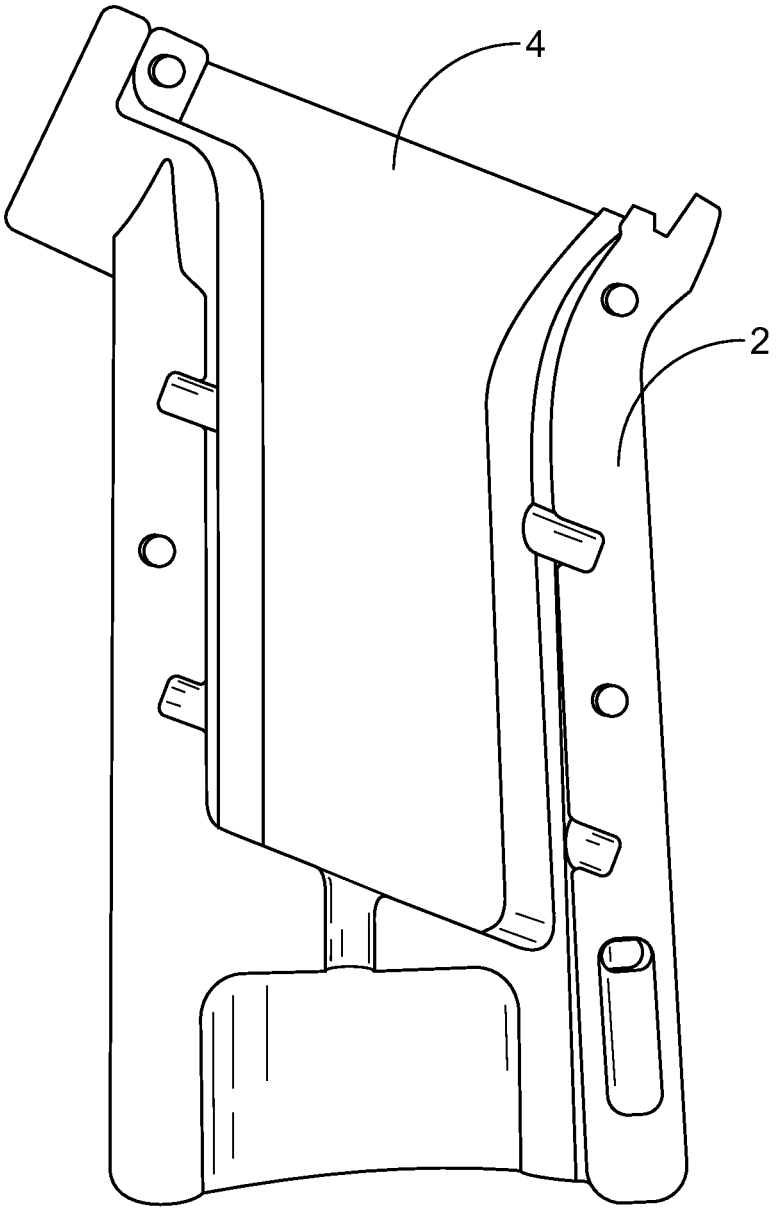
FIG. 1 is a cross-sectional view of a bump fire grip.

As seen in FIG. 1, the bump fire grip can comprise an exterior shaft 2 that can have an interior portion 4 that can be partially hollow.

Figure 2:
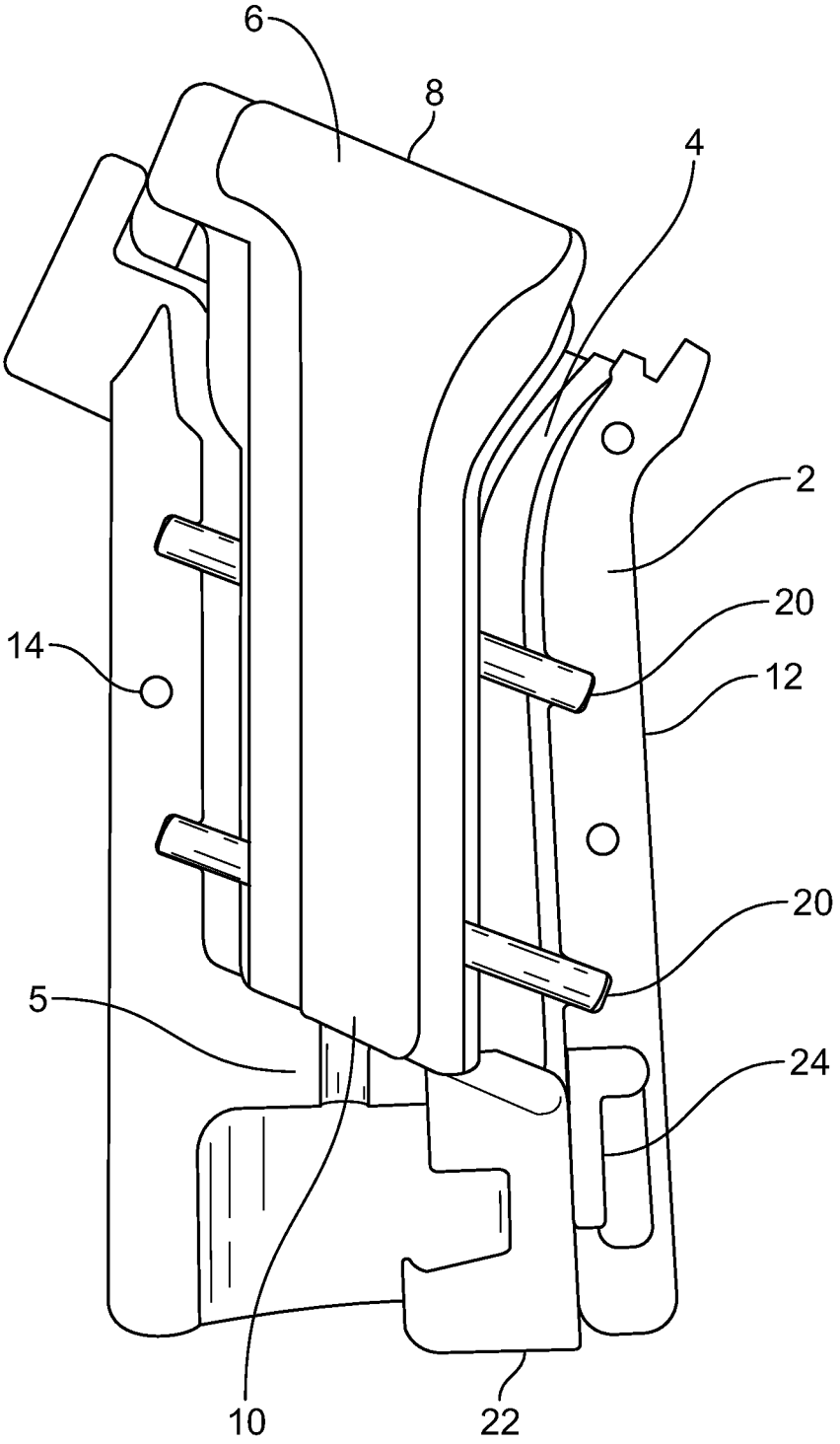
FIG. 2 is a cross-sectional view of a bump fire grip with an interior shaft included.
Figure 3:
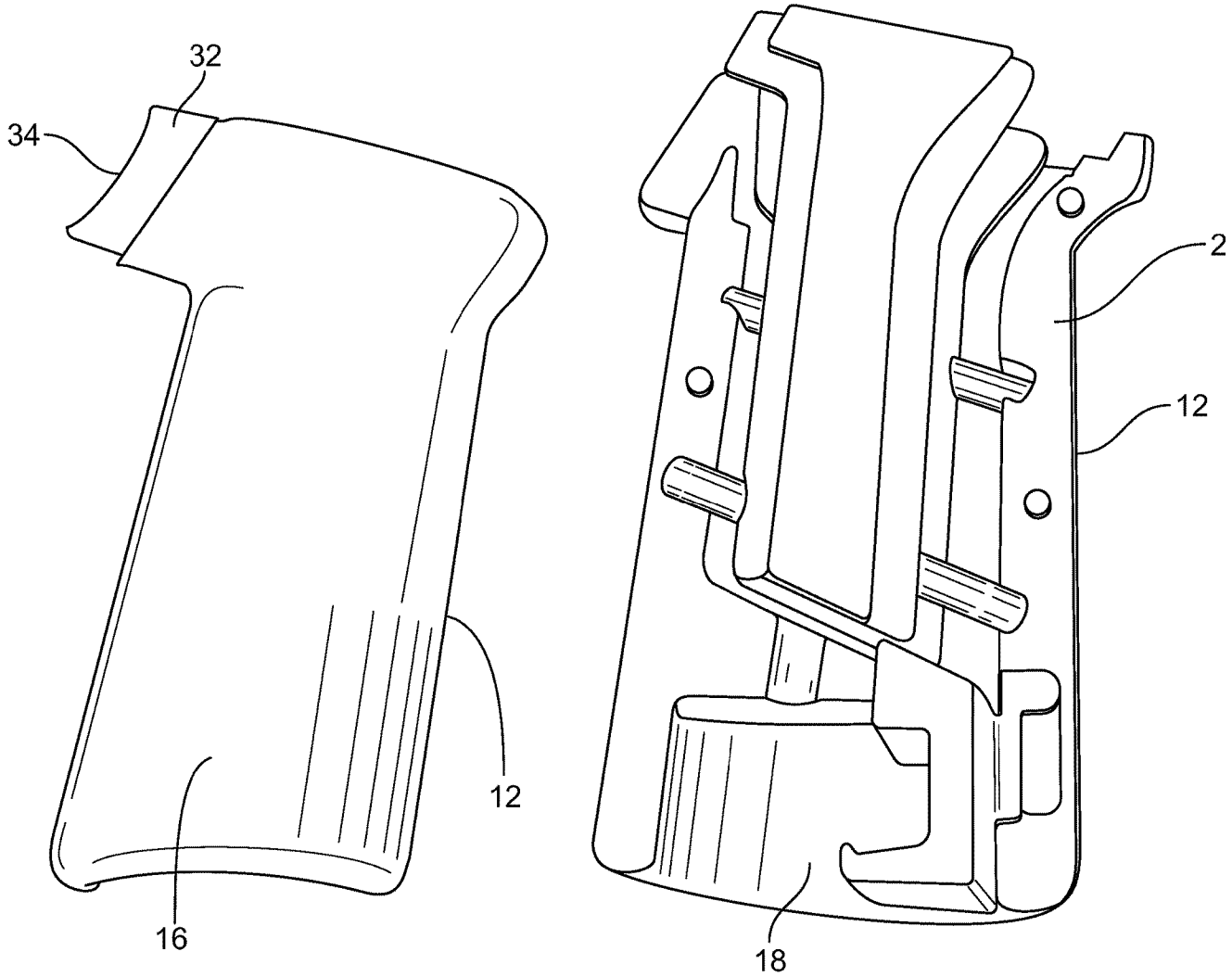
FIG. 3 is a perspective, dismantled view of a bump fire grip.
Figure 4:
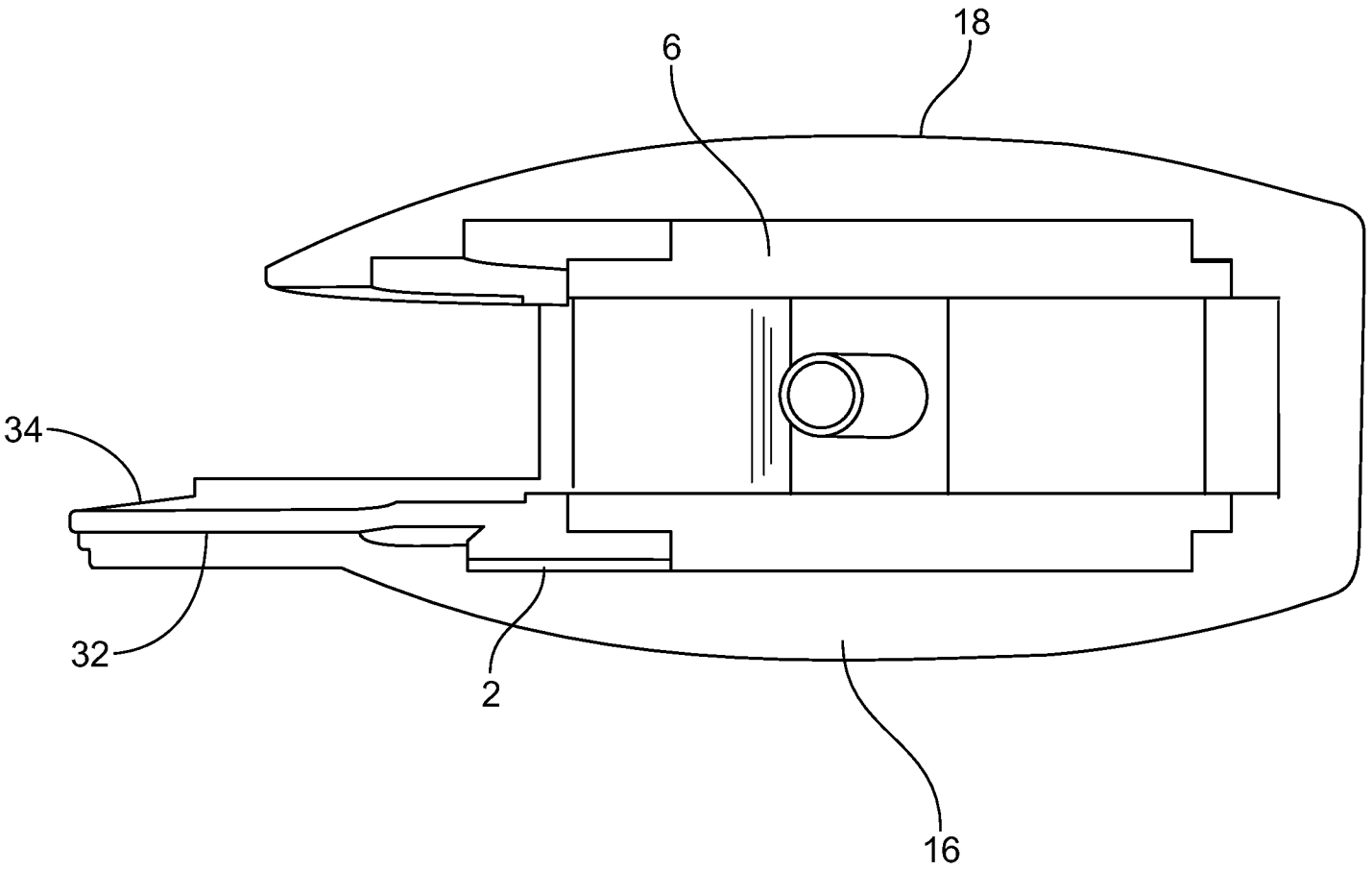
FIG. 4 is a top view of a bump fire grip.

As seen in FIG. 2, the interior portion 4 of the exterior shaft 2 can be configured to house an interior shaft 6. The interior shaft 6 can include a proximal end 8 and a distal end 10. The proximal end 8 can be configured to releaseably attach to a gun barrel, such as through a screw. Other attachment means, such as clips or a tongue-in-grove configuration, may be used. The interior shaft 6 can extend into the interior portion 4 of the exterior shaft 2, with the interior shaft 6 terminating within the interior portion 4. The exterior shaft 2 can include an interior ledge 5 that can contact the proximal end 8 of the interior shaft 6, holding the interior shaft 6 within the exterior shaft 2. The exterior shaft 2 can have a back end 12 and a front end 14. As shown in FIG. 3, the exterior shaft 2 can also have a left side 16 when viewed from the back end 12, and a right side 18 when viewed from the back end 12. The interior shaft 6 can be configured such that a gap can exist between the interior shaft 6 and the back end 12 and front end 14 of the exterior shaft 2. This gap can allow the interior shaft 6 to slide from the front end 14 to the back end 12, and vice versa. The interior shaft 6 can also be configured such that no gap exists between the interior shaft 6 and the left side 16 and right side 18 of the exterior shaft 2, as shown in FIG. 4.

Referring to FIG. 2, the exterior shaft 2 can include at least one pin 20 (two pins 20 are shown in FIG. 2 by way of example). The pins 20 can be lockedly engaged in the front end 14 and back end 12 of the exterior shaft. The pins 20 can also be configured to extend through the interior shaft 6, but not be attached to the interior shaft 6. This configuration, for example, can allow the interior shaft 6 to slide within the interior portion 4 of the exterior shaft 2, using the pins 20 as guides or stabilizers. In one embodiment, the pins 20 can be set at an angle from the front end 14 and back end 12 of the exterior shaft 2. The angle at which the pins 20 are set can be substantially similar to the angle of the proximal end 8 and distal end 10 of the interior shaft 6. In this embodiment, the interior shaft 6 can slide at the angle that the pins 20 are set. The angle at which the pins 20 are set can be such that the pins 20, proximal end 8, and distal end 10 are substantially parallel to the gun barrel when the bump fire grip is releaseably attached to the gun barrel.

Figure 5:
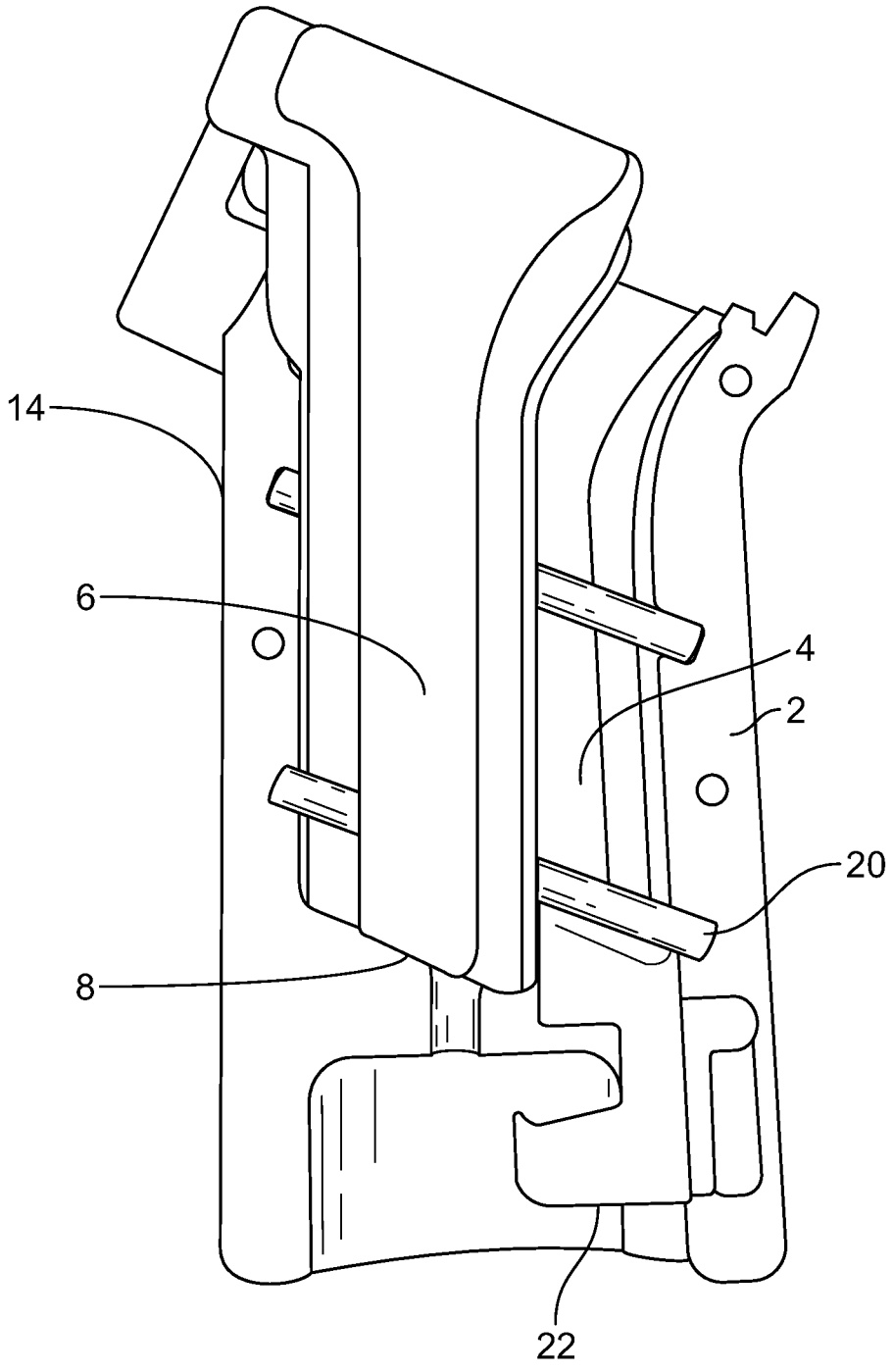
FIG. 5 is a cross-sectional, perspective view of a bump fire grip.

Referring to FIG. 5, the exterior shaft 2 can also be configured to hold a locking mechanism 22. In one embodiment, the locking mechanism 22 can be located at the distal end of the exterior shaft 2 and can be configured to extend at least partially into the interior portion 4 of the exterior shaft 2 when the interior shaft 6 is pressed against the front end 14 of the exterior shaft 2 (shown in FIG. 5). The locking mechanism 22 can be pushed into the interior portion 4 of the exterior shaft 2 until the top of the locking mechanism 22 makes contact with the pin 20, or until the side of the locking mechanism 22 makes contact with the side of the interior shaft 6.

Figure 6:
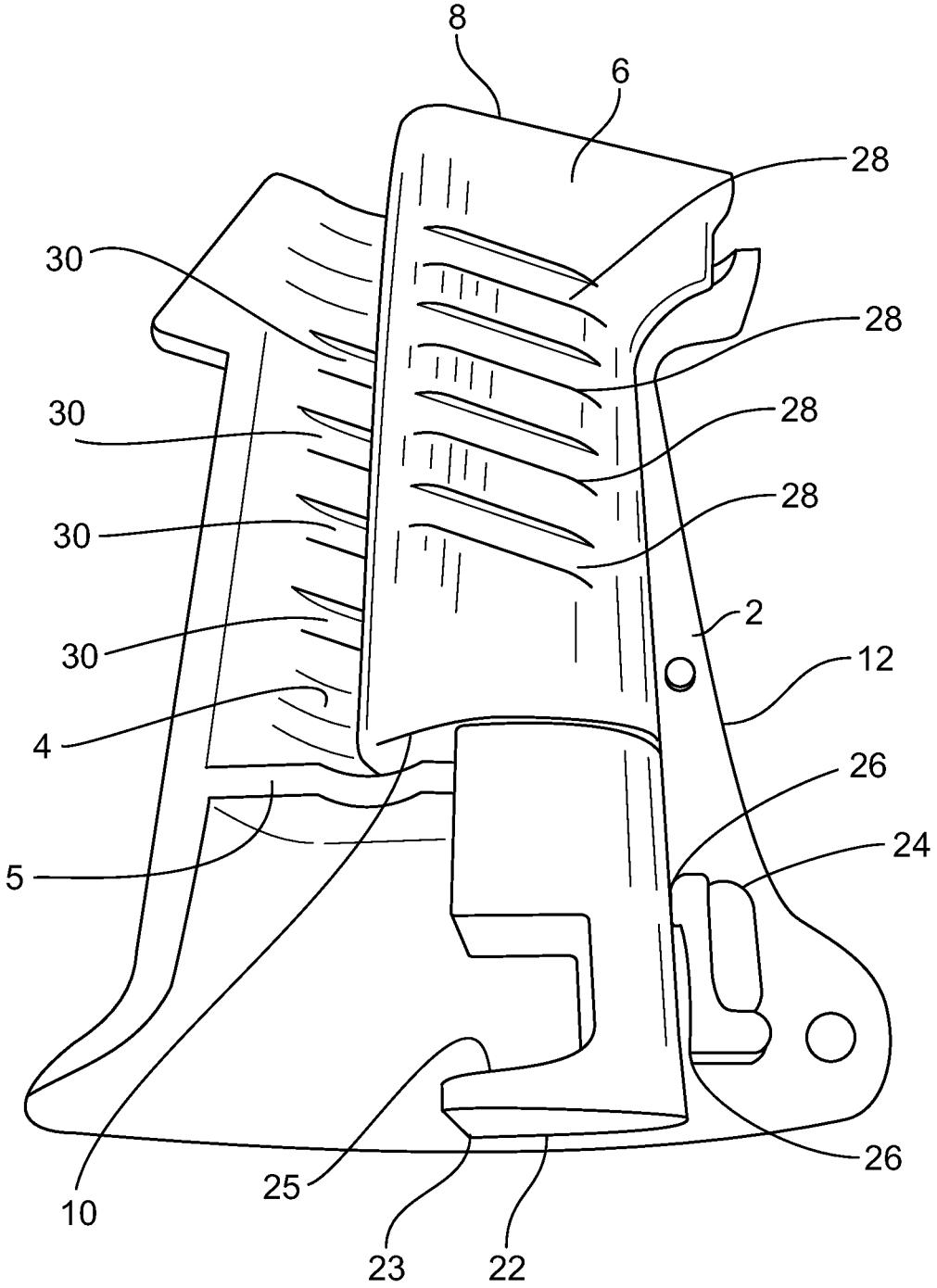
FIG. 6 is a cross-sectional, perspective view of a bump fire grip.

Referring to FIG. 6, the placement of the locking mechanism 22 at least partially within the interior shaft 6 can be maintained by a prong 24 located in the exterior shaft 2 that releaseably engages with at least one grove 26 in the locking mechanism 22. When the locking mechanism 22 is engaged (shown in FIG. 5), the interior shaft 6 can be unable to slide from the front end 14 to the back end 12 of the exterior shaft 2, and vice versa. Thus, when the locking mechanism 22 is engaged, bump firing cannot occur and the grip can be used by the operator as a common grip. The locking mechanism 22 can be disengaged by pulling the locking mechanism 22 toward the distal end of the exterior shaft 2 and out of the interior portion 4, as shown in FIG. 2, which can allow the interior shaft 6 to slide from the front end 14 to the back end 12 of the exterior shaft 2. The locking mechanism 22 can be engaged and disengaged at the operator's discretion.

Referring to FIG. 6, to aid in engaging the locking mechanism 22, the locking mechanism 22 can have a substantially flat bottom 23 configured to allow an operator to push the locking mechanism 22 at least partially into the interior portion 4 of the exterior shaft 2. To aid in disengaging the locking mechanism 22, the locking mechanism 22 can have a lip 25 configured to allow an operator to pull the locking mechanism 22 out of the interior portion 4 of the exterior shaft 2.

By providing a locking mechanism 22 to the bump fire grip, the grip can be used for bump firing or for conventional firing of a firearm without the need to switch grips or otherwise deconstruct and reconstruct the weapon. As such, the operator need not purchase multiple grips and may maintain only the presently disclosed bump fire grip to fire the weapon with or without bump firing.

Still referring to FIG. 6, the bump fire grip can comprise a male/female jointed design instead of, or in addition to, the use of pins 20. As shown in FIG. 6, the exterior wall of the interior shaft 6 can comprise female groves 28 configured to receive male groves 30 on the interior wall of the exterior shaft 2. In another embodiment, the male groves 30 can be situated on the exterior wall of the interior shaft 6, and the female groves 28 can be situated on the interior wall of the exterior shaft 2. The male/female jointed design can include as little as one male/female joint or multiple male/female joints. In the example shown in FIG. 6, the male/female jointed design includes four male/female joints. As with the pins 20 described above, the male groves 30 and female groves 28 can be set at an angle from the front end 14 and back end 12 of the exterior wall 2, such that the male groves 30 and female groves 28 are substantially parallel to the gun barrel when the bump fire grip is releaseably attached to the gun barrel. The angle of the male groves 30 and female groves 28 can also be substantially similar to the proximal end 8 and distal end 10 of the interior shaft 6. The use of a male/female jointed design may result in more friction between the interior shaft 6 and the exterior shaft 2, which may be useful for certain pistol designs and ammunition calibers. The use of a male/female jointed design may also result in minimized production costs and assembly times for the bump fire grip.

The present disclosure can be made of one or more of various materials, including but not limited to metal and polymers. When made of metal, the present disclosure can be made of any metal with suitable strength and malleability, such as steel, to create the device described herein. When made of metal, the present disclosure can be milled or otherwise formed using known methods of metal working or metal forming. When made of a polymer, the present disclosure can be made using any method of polymeric molding. By way of example, the present disclosure can be made by creating an injection mold of the bump fire grip and injecting a polymer or polymeric mixture into the mold. One having ordinary skill in the art will know the temperature, pressure, and time required to create a bump fire grip by the injection molding technique described herein. The present disclosure can also be milled or otherwise cut to the bump fire grip described and shown herein. The bump fire grip may also include notches, groves, curvatures, and other formations not specifically reference herein to allow the grip to attach to the barrel of differing pistols or to promote the efficient sliding of the interior shaft 6 within the exterior shaft 2. The bump fire grip may be used on any number of firearm models, but by way of example as shown in FIGS. 7-8, the bump fire grip can be used on AK (Avtomat Kalashnikova) and AR (ArmaLite) model pistols, respectively.

In one embodiment, the exterior shaft 2 of the bump fire grip can be configured as one piece. In another embodiment, the exterior shaft 2 of the bump fire grip can be configured as two pieces that can be combined as depicted in FIG. 3. The use of a one-piece exterior shaft 2 may result in increased durability to the bump fire grip, while the use of a two-piece exterior shaft 2 may allow for easier access to the interior shaft 6 and pins 20, if used. When the two-piece design is used, the pieces may be held together with any fastening means, such as a tongue-in-grove design or a wrapping around the outside of the exterior shaft 2. The exterior of the bump fire grip can comprise indents for the operator's fingers to rest in, as well as rubber or other material to aid in the operator's grip on the firearm. The exterior of the bump fire grip may also include ornamentation as desired by the operator or manufacturer.

Figure 7:
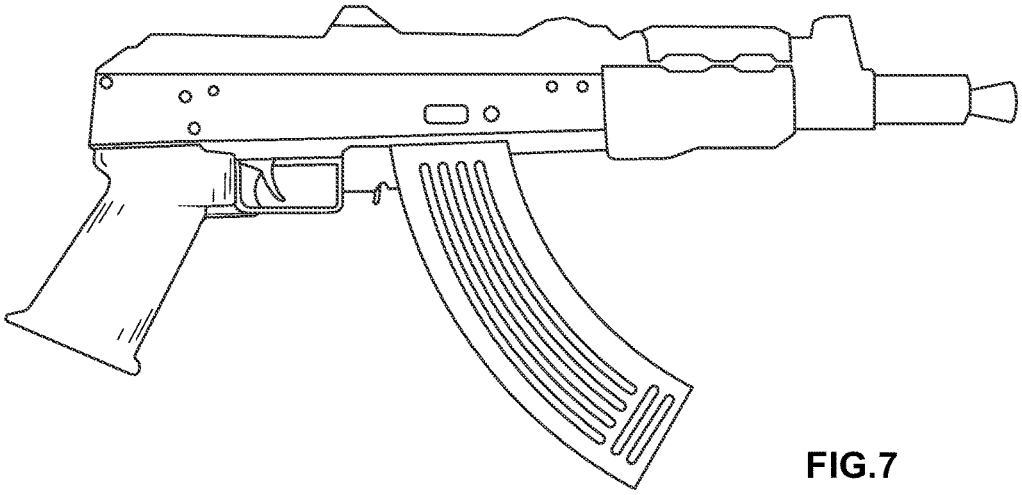
FIG. 7 is a view of a bump fire grip as attached to a pistol.
Figure 8:
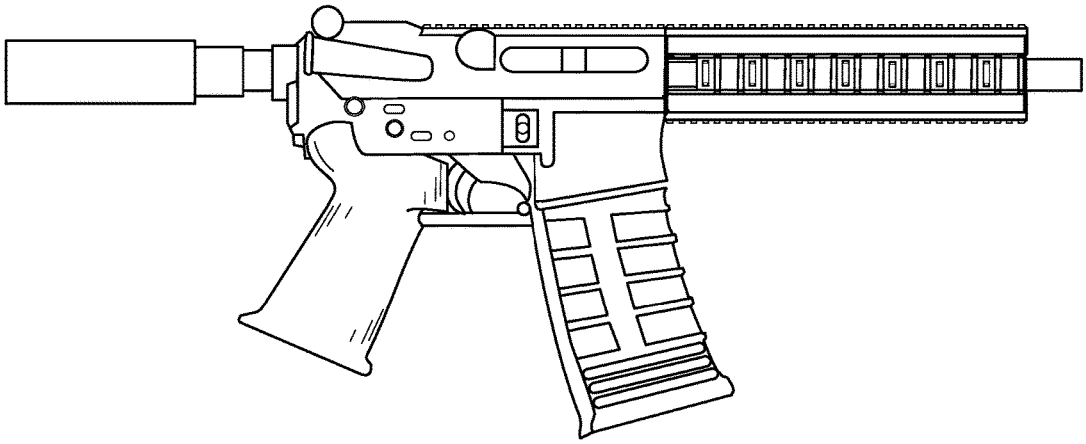
FIG. 8 is a view of a bump fire grip as attached to a pistol.
Figure 9:
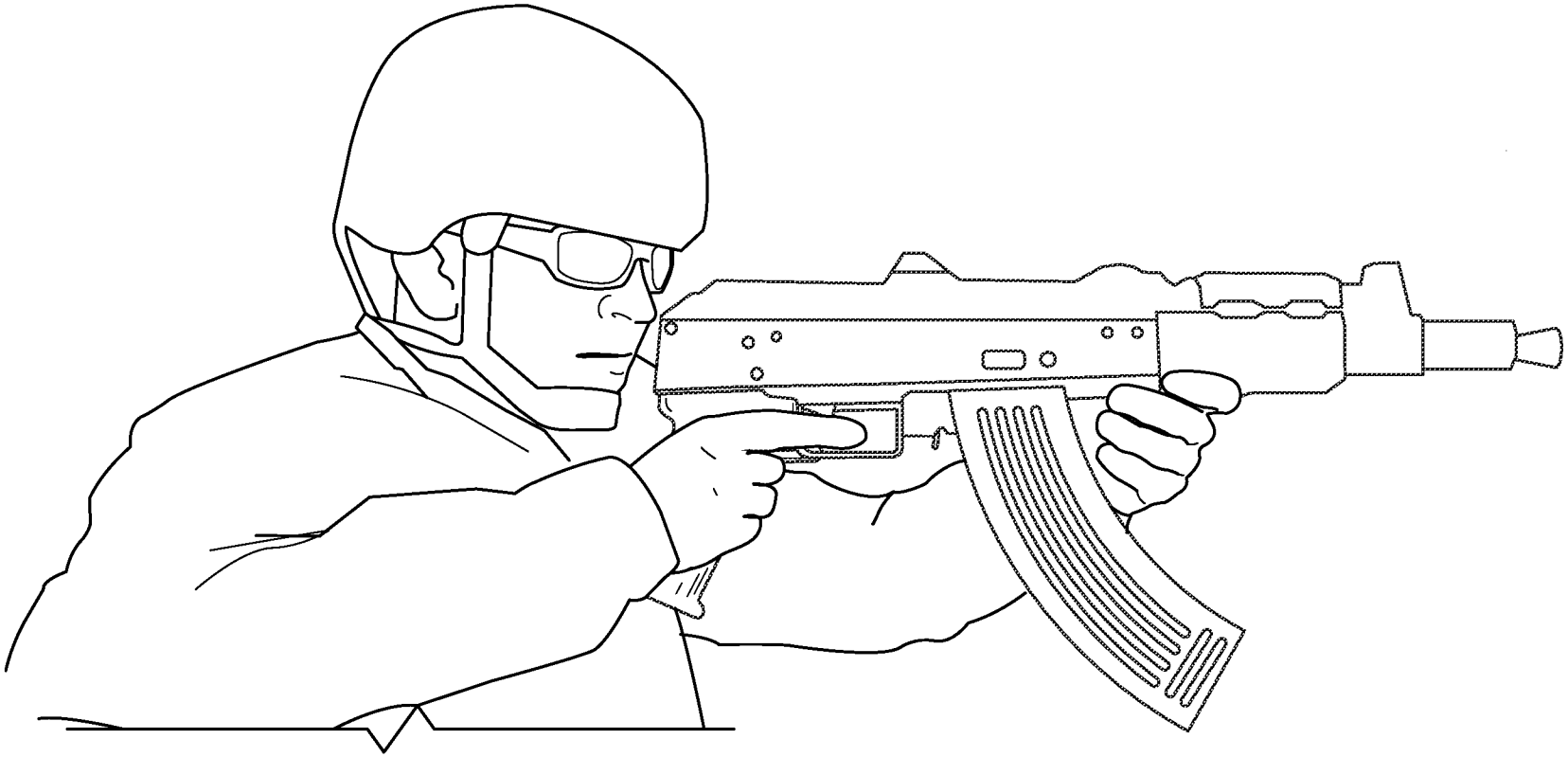
FIG. 9 is a view of a bump fire grip as attached to a pistol held by an operator.

In use, the various components of the bump fire grip as described herein can be assembled and the bump fire grip can be releaseably attached to the barrel of a firearm, as shown in FIGS. 7-8. The locking mechanism 22 can be disengaged, allowing the bump fire grip to slide front to back from the barrel. A magazine of ammunition can be attached to the firearm and any safety device or trigger can be disengaged to allow firing of the weapon. The weapon can be held by the operator such that the operator's trigger hand—most typically the operator's dominant hand—is positioned on the bump fire grip, with the operator's index finger on the trigger. Referring to FIGS. 3 and 4, for an operator gripping the bump fire grip with his or her right hand, a portion of the left side 16 of the exterior shaft 2 can be configured to extend toward the muzzle of the firearm more than the right side 18 of the exterior shaft 2, creating a brace 32. The brace 32 can include an indent 34 configured to allow the operator's trigger finger to be received by the indent 34. As such, when the bump fire grip his held, the operator's trigger finger extends over the firearm's trigger and rests in the indent 34 of the brace 32. The operator's palm, thumb, and remaining fingers are placed on the exterior shaft 2 as would typically be done when firing a weapon. The operator's non-trigger hand can be placed on the barrel of the weapon. As shown in FIG. 9, the operator's non-trigger hand can be placed on a grip situated on the barrel of the weapon.

The operator, taking precautions normally taken when firing a weapon, can then apply force in the direction of the firearm's muzzle with the operator's non-trigger hand. The forward force can cause the barrel of the weapon to slide forward on the bump fire grip, causing the weapon's trigger to contact the operator's trigger finger, firing the weapon. The recoil from the shot can slide the barrel of the weapon back on the bump fire grip, but the continued forward force applied by the operator's non-trigger hand slides the barrel forward again, causing the weapon to fire a subsequent time. The operator can continue to apply forward force, causing the barrel to slide back and forth on the bump fire grip in rapid succession, allowing for multiple shots to be fired in a short span of time. The bump firing can cease when the operator stops pushing the weapon forward or when the magazine of ammunition has been expended.

An operator intending to use the firearm without bump firing can engage the locking mechanism 22. The operator may also desire to engage the locking mechanism 22 of the bump fire grip when the weapon is not in use to promote safe storage of the weapon.

While this invention has been described as having exemplary designs, the present invention may be further modified within the spirit and scope of the disclosure. This application is therefore intended to cover any variations, uses, or adaptations of the invention using its general principles. Further, this application is intended to cover such departures from the present disclosure as come within known or customary practice in the art to which this invention pertains.

In one general aspect, the present disclosure is directed to a pistol grip comprising an exterior shaft having an interior portion that is at least partially hollow and configured to house an interior shaft. The exterior shaft comprises a front wall located in the direction of a gun muzzle, a back wall located in the direction of a gun hammer, and two side walls. The interior shaft is sized to contact the two side walls but not to contact the front wall and back wall at the same time. The interior shaft also comprises a proximal end configured to releaseably attach to a gun barrel and a distal end that terminates within the interior portion of the exterior shaft. The exterior shaft also comprises at least one pin configured to extend from the back wall of the exterior shaft, through the interior shaft, and terminate in the front wall of the exterior shaft. The pin is configured to be lockedly engaged in the back and front walls of the exterior shaft, but not lockedly engaged to the interior shaft, allowing the interior shaft to slide on the pin from the back wall to the front wall.

In various implementations, the exterior shaft is configured to include a distal end. The distal end is configured to include a locking mechanism, which is configured to allow at least a portion of the locking mechanism to extend into the interior portion of the exterior shaft such that the locking mechanism makes contact with the interior shaft and prevents the interior shaft from sliding on the pin. Also, the locking mechanism can be configured to contact the back wall of the exterior shaft, and the portion of the back wall that contacts the locking mechanism can be configured to include at least one tab while the portion of the locking mechanism that contacts the back wall of the exterior shaft can be configured to include a first grove and a second grove configured to receive the tab. The first grove can be configured such that when the tab is received by the first grove, the locking mechanism does not extend into the interior portion of the exterior shaft, and the second grove can be configured such that when the tab is received by the second grove, the locking mechanism extends at least partially into the interior portion of the exterior shaft.

In other implementations, the locking mechanism can include a substantially flat bottom configured to allow an operator to push the locking mechanism at least partially into the interior portion of the exterior shaft, and the locking mechanism can include a lip configured to allow an operator to pull the locking mechanism out of the interior portion of the exterior shaft. Also, the exterior shaft can include an interior ledge situated within the interior portion of the exterior shaft that is configured to contact the distal end of the interior shaft, holding the interior shaft within the interior portion of the exterior shaft. Furthermore, the proximal and distal ends of the interior shaft and the interior ledge can be configured at an angle between 0 and 90 degrees from the plain of the back wall. Also, one of the two side walls of the exterior shaft can be configured to extend toward the muzzle more than the other of the two side walls, creating a brace, and the brace can be configured to include an indent such that the operator's finger can fit at least partially within the indent. The exterior shaft can be configured as at least two pieces that releaseably couple to form the exterior shaft. Additionally, the distance from the back wall to the front wall that the interior shaft can slide on the pin can be between 1 and 20 millimeters.

In another general aspect, the present disclosure is directed to a pistol grip comprising an exterior shaft having an interior portion that can be at least partially hollow and configured to house an interior shaft. The exterior shaft can comprise a front wall located in the direction of a gun muzzle, a back wall located in the direction of a gun hammer, and two side walls. The interior shaft can be sized to contact the two side walls but not to contact the front wall and back wall at the same time. The interior shaft can also comprise a proximal end configured to releaseably attach to a gun barrel, and a distal end that can terminate within the interior portion of the exterior shaft. The exterior shaft can also be configured to include at least one male grove on the interior of the side walls, while the interior shaft can be configured to include at least one female grove on at least a portion of the interior shaft that makes contact with the side walls of the exterior shaft. The female grove on the interior shaft can be configured to receive the male grove on the exterior shaft, and the male grove on the exterior shaft and the female grove on the interior shaft, when engaged, can be configured to hold the interior shaft within the interior portion of the exterior shaft and allow the interior shaft to slide from the front wall to the back wall of the exterior shaft.

In various implementations the exterior shaft can be configured to include a distal end that can be configured to include a locking mechanism. The locking mechanism can be configured to allow at least a portion of the locking mechanism to extend into the interior portion of the exterior shaft such that the locking mechanism can make contact with the interior shaft and prevent the interior shaft from sliding on the male and female groves. Also, the locking mechanism can be configured to contact the back wall of the exterior shaft and the portion of the back wall that contacts the locking mechanism can be configured to include at least one tab while the portion of the locking mechanism that contacts the back wall of the exterior shaft can be configured to include a first grove and a second grove configured to receive the tab. The first grove can be configured such that when the tab is received by the first grove, the locking mechanism does not extend into the interior portion of the exterior shaft, and the second grove can be configured such that when the tab is received by the second grove, the locking mechanism extends at least partially into the interior portion of the exterior shaft.

In other implementations, the locking mechanism can include a substantially flat bottom configured to allow an operator to push the locking mechanism at least partially into the interior portion of the exterior shaft, and the locking mechanism can include a lip configured to allow an operator to pull the locking mechanism out of the interior portion of the exterior shaft. Also, the exterior shaft can include an interior ledge situated within the interior portion of the exterior shaft that is configured to contact the distal end of the interior shaft, holding the interior shaft within the interior portion of the exterior shaft. Furthermore, the proximal and distal ends of the interior shaft and the interior ledge can be configured at an angle between 0 and 90 degrees from the plain of the back wall. Also, one of the two side walls of the exterior shaft can be configured to extend toward the muzzle more than the other of the two side walls, creating a brace. The brace can be configured to include an indent such that the operator's finger can fit at least partially within the indent. The exterior shaft can be configured as at least two pieces that releaseably couple to form the exterior shaft. Additionally, the distance from the back wall to the front wall that the interior shaft can slide on the male and female groves can be between 1 and 20 millimeters.

In another general aspect, the present disclosure is directed to a pistol grip comprising an exterior shaft having an interior portion that can be at least partially hollow and configured to house an interior shaft. The exterior shaft can comprise a front wall located in the direction of a gun muzzle, a back wall located in the direction of a gun hammer, and two side walls. The interior shaft can be sized to contact the two side walls but not to contact the front wall and back wall at the same time. The interior shaft can also comprise a proximal end configured to releaseably attach to a gun barrel, and a distal end that terminates within the interior portion of the exterior shaft. The interior shaft can be sized such that the interior shaft can slide from the front wall to the back wall of the exterior shaft.

In various implementations, the exterior shaft can be configured to include a distal end configured to include a locking mechanism. The locking mechanism can be configured to allow at least a portion of the locking mechanism to extend into the interior portion of the exterior shaft such that the locking mechanism makes contact with the interior shaft and prevents the interior shaft from sliding.

What is claimed is:

1. A pistol grip, comprising:

an exterior shaft having an interior portion that is at least partially hollow and that houses an interior shaft;

the exterior shaft comprises a front wall located in the direction of a gun muzzle, a back wall located in the direction of a gun hammer, and two side walls;

the interior shaft is sized to contact the two side walls but not to contact the front wall and back wall at the same time;

the interior shaft also comprises a proximal end configured to releaseably attach to a gun barrel receiver, and a distal end that terminates within the interior portion of the exterior shaft;

the exterior shaft also includes at least one male groove on the interior of the side walls;

the interior shaft includes at least one female groove on at least a portion of the interior shaft that makes contact with the side walls of the exterior shaft;

the female groove on the interior shaft is configured to receive the male groove on the exterior shaft; and the male groove on the exterior shaft and the female groove on the interior shaft, when engaged, hold the interior shaft within the interior portion of the exterior shaft and allow the interior shaft to slide from the front wall to the back wall of the exterior shaft.

2. The device of claim 1, wherein:

the exterior shaft includes a distal end;

the distal end includes a locking mechanism; and the locking mechanism is configured to allow at least a portion of the locking mechanism to extend into the interior portion of the exterior shaft such that the locking mechanism makes contact with the interior shaft and prevents the interior shaft from sliding on the male and female groves.

3. The device of claim 2, wherein:

the locking mechanism contacts the back wall of the exterior shaft;

the portion of the back wall that contacts the locking mechanism includes at least one tab;

the portion of the locking mechanism that contacts the back wall of the exterior shaft includes a first grove and a second grove configured to receive the tab;

the first grove is configured such that when the tab is received by the first grove, the locking mechanism does not extend into the interior portion of the exterior shaft; and the second grove is configured such that when the tab is received by the second grove, the locking mechanism extends at least partially into the interior portion of the exterior shaft.

4. The device of claim 2, wherein:

the locking mechanism includes a substantially flat bottom configured to allow an operator to push the locking mechanism at least partially into the interior portion of the exterior shaft; and the locking mechanism includes a lip configured to allow an operator to pull the locking mechanism out of the interior portion of the exterior shaft.

5. The device of claim 1, wherein:

the exterior shaft includes an interior ledge situated within the interior portion of the exterior shaft; and the interior ledge contacts the distal end of the interior shaft, holding the interior shaft within the interior portion of the exterior shaft.

6. The device of claim 5, wherein the proximal and distal ends of the interior shaft and the interior ledge are situated at a non-right angle from the plain of the back wall.

7. The device of claim 1, wherein:

one of the two side walls of the exterior shaft extends toward the muzzle more than the other of the two side walls, creating a brace; and the brace includes an indent such that the operator's finger can fit at least partially within the indent.

8. The device of claim 1, wherein the exterior shaft is configured as at least two pieces that releaseably couple to form the exterior shaft.

9. The device of claim 1, wherein the distance from the back wall to the front wall that the interior shaft can slide on the male and female groves is between 1 and 20 millimeters.

10. The device of claim 1, wherein the interior shaft includes a fastener, the fastener configured to releasably attach the interior shaft to the gun receiver.

11. The device of claim 1, wherein the interior shaft is not separable from the exterior shaft.

* * * * *